US010188191B2

(12) United States Patent
Dudek

(10) Patent No.: US 10,188,191 B2
(45) **Date of Patent: *Jan. 29, 2019**

(54) LIP EXFOLIATING DEVICE

(71) Applicant: Deanna Dudek, Glenview, IL (US)

(72) Inventor: Deanna Dudek, Glenview, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/871,185

(22) Filed: Jan. 15, 2018

(65) Prior Publication Data

US 2018/0132594 A1 May 17, 2018

Related U.S. Application Data

(63) Continuation of application No. 14/875,547, filed on Oct. 5, 2015, now Pat. No. 9,907,385.

(51) Int. Cl.

| | |
|---|---|
| ***A45D 40/18*** | (2006.01) |
| ***A45D 40/02*** | (2006.01) |
| ***A45D 40/00*** | (2006.01) |
| ***A45D 40/24*** | (2006.01) |

(52) U.S. Cl.

CPC ..... *A45D 40/18* (2013.01); *A45D 40/00* (2013.01); *A45D 40/02* (2013.01); *A45D 40/24* (2013.01); *A45D 2040/0025* (2013.01); *A45D 2200/1054* (2013.01)

(58) Field of Classification Search

CPC ..... A45D 40/18; A45D 40/00; A45D 40/02; A45D 40/24; A45D 2040/0025; A45D 2200/1054; B24D 11/00; B24D 1/00

See application file for complete search history.

(56) References Cited

U.S. PATENT DOCUMENTS

| | | | | |
|---|---|---|---|---|
| 6,557,178 | B1 * | 5/2003 | Hoover | A41D 19/01594 15/227 |
| 6,682,400 | B2 * | 1/2004 | Draper | B24D 15/023 451/28 |
| 8,057,286 | B2 * | 11/2011 | Walsh | B24D 15/04 451/495 |
| 8,662,962 | B2 * | 3/2014 | Petersen | B24D 11/02 451/533 |

* cited by examiner

*Primary Examiner* — David Walczak
(74) *Attorney, Agent, or Firm* — Aaron Perez-Daple

(57) ABSTRACT

A lip exfoliator includes an exfoliant with one or more dry abrasive materials for exfoliation of the lips, which may be provided as a single compact unit. Embodiments of a lip exfoliator may include an attachment surface—such as an adhesive sticker, suction device, or cup mechanism—for attaching the lip exfoliator to a lip balm or other cosmetic. Thus, a consumer may use embodiments of the lip exfoliator with a lip balm or cosmetic of their choice easily while on the go.

13 Claims, 3 Drawing Sheets

LIP EXFOLIATING DEVICE

CROSS-REFERENCE TO RELATED APPLICATIONS

This application is a continuation of U.S. patent application Ser. No. 14/875,547 filed Oct. 5, 2015, now U.S. Pat. No. 9,907,385.

BACKGROUND

This disclosure relates to health and beauty products and devices—and their methods of use—for exfoliating lips to improve the appearance and health of the lips.

Most areas of human skin have sebaceous glands, which produce oil (sebum) to moisturize and protect the skin, and sweat (sudoriferous) glands, which provide moisture and regulate body temperature. In contrast, the lips have no sebaceous glands and no sweat glands. Saliva is the only natural source of lubrication for the lips, which makes them particularly vulnerable to becoming dry and chapped. For this reason, there are many products on the market for protecting and beautifying lips, including a wide range of lip balms, glosses, and lipsticks. However, because of the lack of natural oils, lips cannot adequately wick away salts and other debris—e.g., food particles, sugars, chemicals, dry skin, etc.—before the application of such a lip balm, gloss, or lipstick, which may serve only to seal in debris against the lips. As a result, even when a product is applied to the lips, they may still become dry and chapped. This is why chapped lips can occur even with the application of a lip balm or other product.

As used herein, the term "lip balm" includes, without limitation, lip balms, lip glosses, lip sticks, and other cosmetics for treating or beautifying the lips.

Currently there exist products intended to help prevent the problem of chapped lips when applying a lip balm. However, these existing products all suffer from drawbacks. For example, existing lip scrubs require the use of water with the scrub, which means that normally they would be applied in front of a bathroom sink and require several steps to apply and remove. This can be time-consuming and inconvenient when on the go.

Also, lip balms exist which include a solvent for dissolving salt and sugars on the lips. After applying such a balm, the consumer is supposed to rub their lips together to dissolve the debris. However, this method requires the consumer to rub their lips together aggressively, which can be uncomfortable, unattractive, and frequently ineffective. It is, in fact, quite difficult to dissolve all of the salt and sugar particles from the lips using this method. In most cases, the consumer is supposed to leave the balm on their lips after application, which means that the salts and sugars are never completely removed. Thus, small salt and sugar particles are left on the lips along with excess balm. Moreover, such lip balms only include solvents for certain types of debris and, thus, may be completely ineffective at removing other types of particles.

There are dry abrasives which may be used for exfoliating lips. However, such dry abrasives have not been integrated into an end product in a way that is convenient and easy for the consumer to use with their preferred lip balm while on the go.

Thus, there is a need for an effective lip exfoliator that is convenient and easy for the consumer to use while on the go.

The present invention(s) are directed towards lip exfoliating devices and methods that solve these and other problems in the art.

SUMMARY OF THE DISCLOSURE

The present disclosure relates to lip exfoliators that are convenient and easy to use while on the go. Lip exfoliators of the present disclosure may have an exfoliant that incorporates one or more dry abrasive materials for exfoliation. Such dry abrasive materials advantageously do not require the use of water—nor access to a sink—for application. Moreover, the consumer does not need to rub their lips together in order to remove debris from their lips when using lip exfoliators of the present disclosure. To the contrary, the consumer may simply rub the lip exfoliator along the lips until they are adequately exfoliated, a quick and easy process.

In some embodiments, lip exfoliators of the present disclosure may be provided as a single unit. Advantageously, the lip exfoliator may be compact, relatively small, and easy to carry in a purse or cosmetic bag. The lip exfoliator may be attached to a lip balm for convenience and ease of use. For example, embodiments of the lip exfoliator may include an attachment surface—such as an adhesive sticker, suction device, or cup mechanism—for attaching the lip exfoliator to a lip balm or other cosmetic. Thus, the consumer may use the lip exfoliator with the lip balm or cosmetic of their choice and need not purchase a particular lip balm together with the lip exfoliator.

Alternatively, in other embodiments, lip exfoliators of the present disclosure may be integrated into the cap or body of a lip balm or other cosmetic. In these embodiments, the lip exfoliator may be packaged together with a particular lip balm. Integrating a lip exfoliator into a lip balm may provide an additional incentive for consumers to purchase the product.

In embodiments of the present disclosure, a lip exfoliator may include an exfoliant with an active surface having a dry abrasive material suitable for application to the lips. The lip exfoliator also may include a bottom section and a binding mechanism that attaches the exfoliant to the bottom section, thereby creating a single unit. The bottom section may include an attachment surface capable of attaching the lip exfoliator to a lip balm or other cosmetic. A cap or cover also may be provided for protecting the active surface when not in use.

In other embodiments of the present disclosure, a lip balm may have a body containing a balm suitable for application to the lips. The body may have a first opening for distributing the balm along the lips and a cap for covering the first opening. The body also may contain an exfoliant made, at least in part, of a dry abrasive material suitable for application to the lips. The exfoliant may have an active surface accessible through a second opening in the body. A cap or cover may be provided for protecting the active surface when not in use.

In still other embodiments of the present disclosure, a cap may be configured to attach to a body of a lip balm. The cap may include an exfoliant at its end. The exfoliant may include a dry abrasive material suitable for application to the lips. A cap or cover also may be provided for protecting the exfoliant when not in use.

The foregoing discussion in the Summary of the Disclosure is exemplary only and should not be used to limit the scope of the claimed invention(s) or the embodiments described below in any way.

DETAILED DESCRIPTION

Figure 1A:
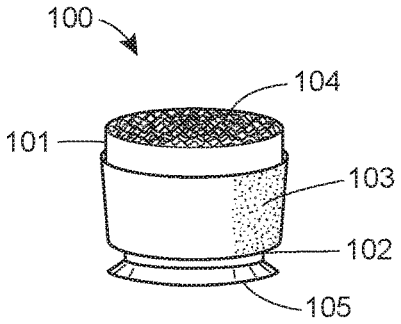
FIG. 1A illustrates an exemplary embodiment of a lip exfoliator with an active surface and an attachment surface.

Lip exfoliators of the present disclosure may have an exfoliant with an active surface for removing salt and other debris from the lips by rubbing the active surface against the lips. The active surface may include one or more dry abrasive materials for exfoliating the lips. In some embodiments, the lip exfoliator also may have an attachment surface for, optionally, attaching the lip exfoliator to a lip balm, cosmetic device, or other convenient location. For example, the attachment surface may include an adhesive sticker or suction device capable of adhering to the surface of a lip balm. A cap or case also may be provided for the lip exfoliator to prevent it from getting dirty while not in use.

Lip exfoliators of the present disclosure may be provided as a single unit, which may be compact, relatively small (e.g., about the diameter of a typical lip balm and about ½ inch in length), and easy to carry in a purse, cosmetic bag, or pocket. Embodiments of the lip exfoliator may be capable of attaching to a lip balm or other cosmetic by the attachment surface. In these embodiments, the lip exfoliator may be used together with a lip balm or other cosmetic of the consumer's choice. After attaching the lip exfoliator to a lip balm, a consumer may grasp the lip balm, using it as a handle when applying the lip exfoliator. Alternatively, the consumer may use the lip exfoliator by itself and may, if already attached, detach the lip exfoliator from the lip balm before application.

In preferred embodiments of the disclosure, the exfoliant may include one or more dry abrasive materials for exfoliating the lips. The consumer may simply rub the active surface of the exfoliant against their lips to remove any accumulated particles or debris. This method of exfoliation is much more convenient than using a lip scrub, because dry abrasives do not require water or a sink. Unlike a lip scrub, the lip exfoliator may be used anywhere while on the go. Dry abrasives also are more effective than lip balms containing solvents. Unlike solvents, dry abrasives can remove all types of debris and particles that may have accumulated on the lips. Lip exfoliators of the present disclosure also act as a beauty aid, because application of dry abrasives improves blood flow to the lips and makes the lips appear more pink.

Natural dry abrasives, such as luffa, may be used safely on the lips and may be included in the exfoliant (and its active surface). Certain foods also act as natural exfoliants when ground and can be used safely on the lips. For example, the exfoliant may include ground particles of flax seeds, cornmeal, oatmeal, and/or other seeds or grains. The exfoliant also may include minerals, such as diamond particles, pumice, or sandstone. A material such as rubber or a natural resin or viscous sugar may be used as a binding agent in the exfoliant for holding in place the exfoliating particles (e.g., food or minerals).

The exfoliant (and its active surface) also may include synthetic materials such as Polytetrafluoroethylene ("PTFE") or a material that mimics the fibrous structure of luffa. Moreover, a synthetic material may be used as a binding agent for dry abrasive particles within the exfoliant and/or disposed on the active surface. Other materials suitable for application to the lips with abrasive properties also may be used in the exfoliant and on the active surface. As would be understood by a person of skill in the art in view of the present disclosure, materials suitable for application to the lips generally should not include toxic materials that are likely to be imbibed by the consumer or materials likely to cut or damage the lips during normal application.

FIG. 1A shows an exemplary embodiment of a lip exfoliator of the present disclosure. In FIG. 1A, lip exfoliator 100 includes exfoliant 101, bottom section 102, and binding mechanism 103. Exfoliant 101 includes active surface 104, which is used to exfoliate the lips. Bottom section 102 includes attachment surface 105, which may be used to optionally attach lip exfoliator 100 to a lip balm or other cosmetic.

As shown in FIG. 1A, binding mechanism 103 joins exfoliant 101 to bottom section 102, thereby creating a single unit 100. Binding mechanism 103 may include an adhesive or elastic material. For example, binding mechanism 103 may be an adhesive tape that wraps around portions of exfoliant 101 and bottom section 102, thereby joining them together. As another example, binding mechanism 103 may be an elastic material that uses elastic force to hold exfoliant 101 and bottom section 102 together. Alternatively or in addition, a glue or other adhesive may be provided between exfoliant 101 and bottom section 102 to join them together. Other binding mechanisms also may be used to join exfoliant 101 and bottom section 102, as would be understood by a person of skill in the art in view of the present disclosure.

Exfoliant 101 and/or active surface 104 may, by way of example and not limitation, include one or more of the following dry abrasives: natural luffa, hemp fibers, pumice, stone, minerals, diamond particles, ground food particles, synthetic luffa, PTFE, Teflon and/or other synthetic materials suitable for application to the lips. The dry abrasive material may be dispersed throughout exfoliant 101, including active surface 104. Alternatively, in some embodiments, the dry abrasive material may be concentrated along active surface 104. For example, diamond particles may be held in place by a binding agent distributed along active surface 104. By concentrating the dry abrasive along the active surface, less dry abrasive material may be used, which may save on the cost of manufacture (e.g., when using diamond or other expensive dry abrasives).

Bottom section 102 may be composed of rubber or plastic material. Attachment surface 105 may include, for example, an adhesive or a suction mechanism. The adhesive may provide a semi-permanent connection to an attached surface or it may be easily removable, depending on the particular adhesive used. Adhesives such as stickers, tape, glue, Velcro™ or other mechanisms may be used, as would be apparent to one of skill in the art in view of the present disclosure. Alternatively, a suction mechanism, such as a flexible plastic (or rubber) cup, may be provided. The suction mechanism may be capable of forming a suction seal between lip exfoliator 100 and the body of a lip balm or other cosmetic.

In other embodiments of the disclosure, attachment surface 105 may be configured to attach to a specific lip balm or cosmetic and may comprise, for example, a screw or snapping mechanism for fitting securely onto a receiving portion of the specific lip balm. In yet other embodiments of the disclosure, lip exfoliator 100 may be provided without attachment surface 105.

Lip exfoliator 100 may be manufactured in various sizes. In preferred embodiments of the disclosure, lip exfoliator 100 may be relatively small and compact. For example, lip exfoliator 100 may have a cylindrical shape with a diameter of less than 1 inch and a height of between ½ to 1 inch. This relatively small size is easy to carry and attach to a lip balm. In alternative embodiments, lip exfoliator 100 may be larger, having a diameter greater than 1 inch, thereby providing a larger surface area for the active surface and facilitating exfoliation. Lip exfoliator 100 also may be manufactured in various other shapes, such as a rectangular or oval shape, as would be understood by a person of skill in the art in view of the present disclosure.

Figure 1B:
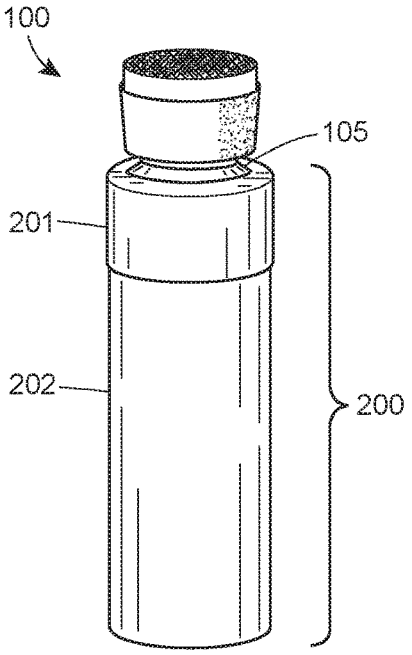
FIG. 1B illustrates an exemplary embodiment of a lip exfoliator attached to the top surface of a lip balm.

FIG. 1B shows an exemplary embodiment in which lip exfoliator 100 is attached to lip balm 200 by attachment surface 105. As illustrated in FIG. 1B, lip exfoliator 100 is attached to cap 201 of lip balm 200. However, lip exfoliator 100 could be attached to other surfaces, as well, such as body 202 of lip balm 200. When attached as shown in FIG. 1*b*, a consumer may optionally apply lip exfoliator 101 by grasping lip balm 200 and using it as a handle, which provides additional leverage and ease of use.

Figure 2:
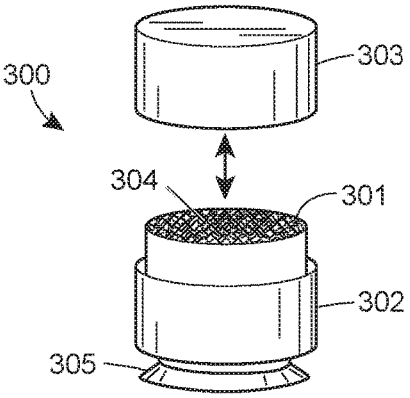
FIG. 2 illustrates an exemplary embodiment of a lip exfoliator having a solid body and a cap.

FIG. 2 shows an exemplary embodiment of a lip exfoliator having a solid body and a cap. As shown in FIG. 2, lip exfoliator 300 includes exfoliant 301 and solid body 302. Cap 303 fits onto solid body 302 and covers active surface 304 of exfoliant 301. Solid body 302 may be composed of hard plastic, metal, or another material of sufficient strength and hardness. Solid body 302 may act to hold exfoliant 301 together with a bottom section that includes attachment surface 305. Solid body 302 may be provided instead of, or in addition to, a binding mechanism, such as an adhesive tape, elastic material, and/or glue.

The embodiment of FIG. 2 provides extra protection for lip exfoliator 300 and a convenient way to carry the device. Solid body 302 and cap 303 prevent exfoliant 301 from becoming damaged or dirty when not in use. Solid body 302 also provides an area for a consumer to grip when using lip exfoliator 300 without an attached lip balm or other cosmetic.

Figure 3A:
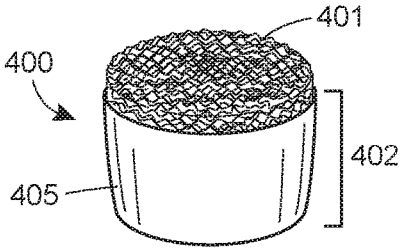
FIG. 3A illustrates a side view of an exemplary embodiment of a lip exfoliator where the attachment surface comprises a cup mechanism.

FIG. 3A shows an exemplary embodiment of a lip exfoliator where the attachment surface includes a cup mechanism. As shown in FIG. 3A, bottom section 402 of lip exfoliator 400 includes cup mechanism 405. Exfoliant 401 may be fitted into a top portion of bottom section 402, as shown in FIG. 3A; or, in other embodiments, exfoliant 401 may be attached to bottom section 402 by a binding mechanism, as described previously with respect to FIG. 1. Cup mechanism 402 may be composed of a material having sufficient elasticity for fitting onto the ends of lip balms of various sizes, such as a soft rubber material. Other materials having sufficient elasticity also may be used for cup mechanism 402, as would be understood by a person of skill in the art in view of the present disclosure.

Figure 3B:
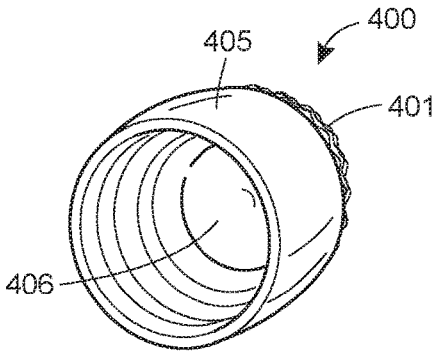
FIG. 3B illustrates an underneath view of an exemplary embodiment of a lip exfoliator where the attachment surface comprises a cup mechanism.
Figure 3C:
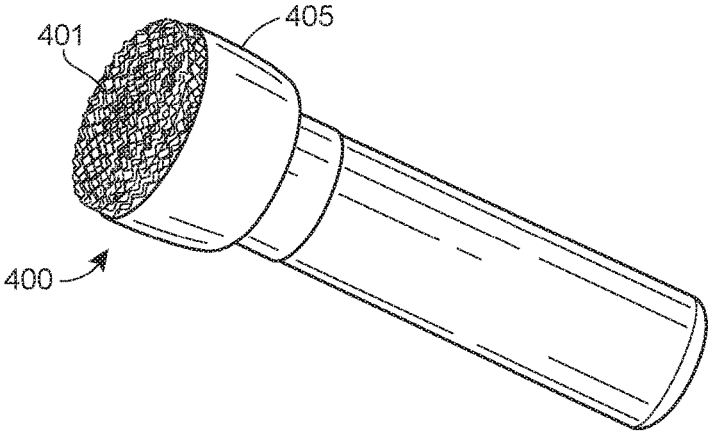
FIG. 3C illustrates an exemplary embodiment of a lip exfoliator attached to a lip balm by a cup mechanism.
Figure 3D:
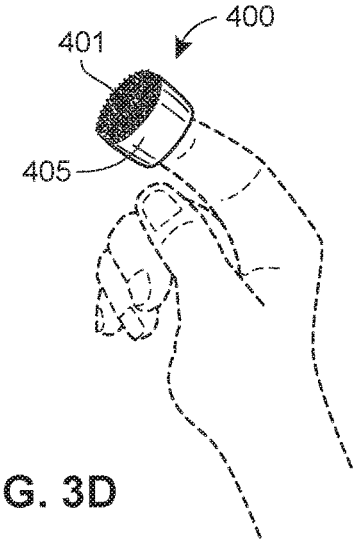
FIG. 3D illustrates an exemplary embodiment of a lip exfoliator attached to a fingertip by a cup mechanism.

FIG. 3B shows a different view, from a bottom angle, of an embodiment having cup mechanism 405. Cup mechanism 405 includes hollow opening 406 for fitting around a lip balm or finger. As shown in FIG. 3C, cup mechanism 405 may be placed over an end of a lip balm, thereby attaching lip exfoliator 400 to the lip balm. As shown in FIG. 3D, cup mechanism 405 also may be placed over the end of a consumer's finger, thereby allowing the consumer to easily apply lip exfoliator 400 to their lips.

In other embodiments of the disclosure, the lip exfoliator may be integrated into the body or cap of a lip balm (or other cosmetic). In these embodiments, the lip exfoliator may be packaged together with a particular lip balm.

Figure 4A:
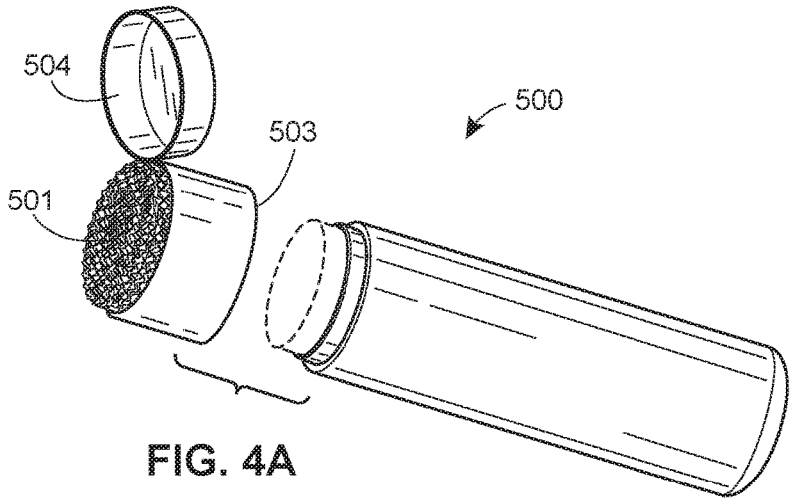
FIG. 4A illustrates an exemplary embodiment of a lip exfoliator integrated into the cap of a lip balm.

FIG. 4A shows an exemplary embodiment in which exfoliant 501 is integrated into cap 503 of lip balm 500. As shown in FIG. 4*a*, exfoliant 501 is disposed at an end of cap 503 for easy application to the lips. For example, a consumer may first exfoliate their lips using exfoliant 501, then remove the cap and apply lip balm to their lips. In some embodiments, cover 504 may be provided for covering exfoliant 501 when not in use. Cover 504 may be attached to cap 503 by a hinge or similar mechanism and may snap shut. Alternatively, cover 504 may detach completely from cap 503 when opened and may snap or screw onto cap 503 when closed.

Figure 4B:
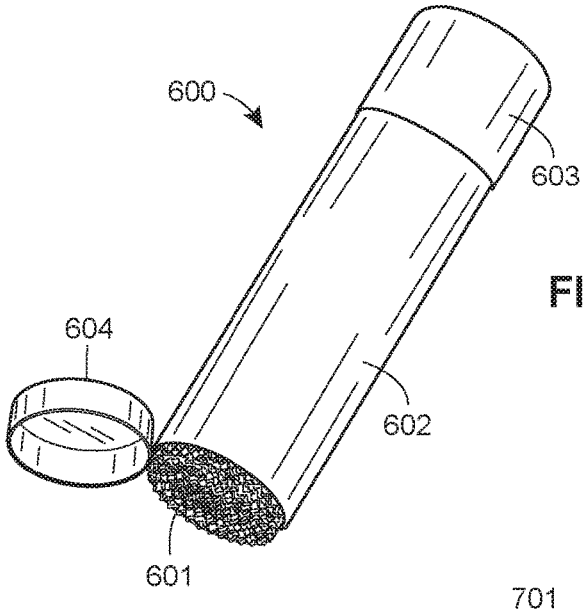
FIG. 4B illustrates an exemplary embodiment of a lip exfoliator integrated into the bottom of a lip balm.

FIG. 4B shows an exemplary embodiment in which exfoliant 601 is integrated into body 602 of lip balm 600. Lip balm 600 may contain a balm suitable for application to the lips within body 602. Body 602 may have a first opening (not shown) for distributing the balm onto the consumer's lips, and cap 603 may be provided to cover the first opening. As shown in FIG. 4B, exfoliant 601 may be disposed in an end opposite cap 603 of lip balm 600. In some embodiments, cover 604 may be provided for covering exfoliant 601 when not in use. Cover 604 may be attached to body 602 by a hinge or similar mechanism and may snap shut. Alternatively, cover 604 may detach completely from body 602 when opened and may snap or screw onto body 602 when closed.

Figure 4C:
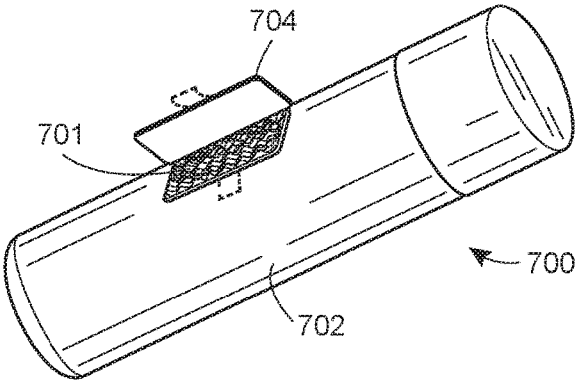
FIG. 4C illustrates an exemplary embodiment of a lip exfoliator integrated into the side of a lip balm.

FIG. 4C shows an exemplary embodiment in which exfoliant 701 is integrated into a side portion of body 702 of lip balm 700. In some embodiments, cover 704 may be provided for protecting exfoliant 701 when not in use. Cover 704 may be attached to body 702 by a hinge or similar mechanism and may snap shut. Alternatively, cover 704 may detach completely from body 702 when opened and may snap onto body 702 when closed.

It should be understood that, while various embodiments have been described herein, the present invention(s) should not be limited by those embodiments. To the contrary, the foregoing written description, figures, and abstract have been presented for illustrative purposes, and are not meant to limit the present invention(s). Indeed, as a person of skill in the art in view of the present disclosure would recognize, various changes can be made to the embodiments described herein without departing from the scope and spirit of the present invention(s).

The invention claimed is:

1. A lip exfoliator comprising:

an exfoliant comprising an active surface, wherein the active surface is composed of an insoluble dry abrasive material comprising a binding agent that holds in place exfoliating particles;

a bottom section comprising an attachment surface;

a binding mechanism configured to attach the exfoliant to the bottom section, wherein the binding mechanism comprises a solid body that at least partially covers the exfoliant; and a cap configured to attach to the solid body, wherein the cap covers the active surface when attached to the solid body, and wherein the attachment surface is adapted to attach to an end of a lip balm by an adhesive.

2. The lip exfoliator of claim 1, wherein the exfoliating particles comprise at least one of: natural luffa, hemp fibers, pumice, stone, diamond particles, food particles, synthetic luffa, Teflon, and PTFE.

3. The lip exfoliator of claim 1, wherein the lip exfoliator has a cylindrical shape with a diameter of less than 1 inch and a height between ½ inch and 1 inch.

4. The lip exfoliator of claim 1, wherein the exfoliating particles are disposed along the active surface.

5. The lip exfoliator of claim 1, wherein the binding agent comprises at least one of: a rubber, a natural resin, and a viscous sugar.

6. A lip exfoliator comprising:

an exfoliant comprising an active surface, wherein the active surface is composed of an insoluble dry abrasive material comprising a binding agent that holds in place exfoliating particles:

a bottom section comprising an attachment surface; and a binding mechanism configured to attach the exfoliant to the bottom section, wherein the attachment surface is adapted to attach to an end of a lip balm by an adhesive, and wherein the binding mechanism comprises an adhesive tape.

7. The lip exfoliator of claim 1, wherein the binding mechanism comprises an elastic material.

8. A lip balm comprising:

a body containing a balm;

a cap configured to removably attach to the body; and an exfoliant composed of an insoluble dry abrasive material comprising exfoliating particles, wherein an end of the cap comprises the exfoliant and, when attached to the body, the cap covers an opening in the body for dispensing the balm.

9. The lip balm of claim 8, further comprising:

a cover attached to the cap and configured to protect an active surface of the exfoliant when closed.

10. The lip balm of claim 9, wherein the exfoliating particles are disposed along the active surface.

11. The lip balm of claim 10, wherein the exfoliating particles are held in place by a binding agent.

12. The lip balm of claim 11, wherein the binding agent comprises at least one of: a rubber, a natural resin, and a viscous sugar.

13. The lip balm of claim 8, wherein the exfoliating particles comprise at least one of: natural luffa, hemp fibers, pumice, stone, diamond particles, ground food particles, synthetic luffa, Teflon, and PTFE.

* * * * *